US005653000A

United States Patent [19]

Lee

[11] Patent Number: 5,653,000

[45] Date of Patent: Aug. 5, 1997

[54] RETRACTABLE HANDLE DEVICE

[76] Inventor: Rui-Ming Lee, 58, Ma Yuan West St., Taichung, Taiwan

[21] Appl. No.: 689,711

[22] Filed: Aug. 16, 1996

[51] Int. Cl.[6] ..... B25G 1/04

[52] U.S. Cl. ..... 16/115

[58] Field of Search ..... 16/115; 190/18 A, 190/18 R, 115, 104, 14, 15 R; 280/47.315, 47.371, 655.1, 655

[56] References Cited

U.S. PATENT DOCUMENTS 2,980,456 4/1961 McMullin ..... 16/115
4,616,379 10/1986 Lio ..... 16/115
4,618,035 10/1986 Mao ..... 16/115
5,379,486 1/1995 Wang ..... 16/115

*Primary Examiner*—Chuck Y. Mah

[57] ABSTRACT

A retractable handle device comprises an outer seat, a middle seat, an inner seat, an outer sleeve, a middle sleeve, an outer pipe, a middle pipe and an inner pipe. The outer seat has an oblong protrusion. The outer seat is fastened at an inner bottom of a suitcase. The outer sleeve is inserted in a first end of the outer pipe. The outer seat is inserted in a second end of the outer pipe. The middle sleeve is inserted in a first end of the middle pipe. A second end of the middle pipe is inserted in the middle seat. A second end of the inner pipe is inserted in the inner seat. The inner pipe is disposed in the middle pipe. The middle pipe is disposed in the outer pipe.

1 Claim, 3 Drawing Sheets

RETRACTABLE HANDLE DEVICE

BACKGROUND OF THE INVENTION

The invention relates to a retractable handle device. More particularly, the invention relates to a retractable handle device of a suitcase.

Most conventional retractable handle devices are operated by buttons. The button may hurt the finger of the user while the retractable handle device is retracted.

SUMMARY OF THE INVENTION

An object of the present invention is to provide a retractable handle device which can be operated manually without any button.

Accordingly, a retractable handle device comprises an outer seat, a middle seat, an inner seat, an outer sleeve, a middle sleeve, an outer pipe, a middle pipe and an inner pipe. The outer sleeve is inserted in a first end of the outer pipe. The outer seat is inserted in a second end of the outer pipe. The middle sleeve is inserted in a first end of the middle pipe. A second end of the middle pipe is inserted in the middle seat. A second end of the inner pipe is inserted in the inner seat. The inner pipe is disposed in the middle pipe. The middle pipe is disposed in the outer pipe. The outer seat has an oblong protrusion. Two opposite round holes and a square hole are formed on the first end of the outer pipe. An oblong hole is formed on the second end of the outer pipe. The oblong protrusion is inserted in the oblong hole. The outer sleeve has a rim flange and two opposite round protrusions disposed on an outer periphery of the outer sleeve. The round protrusions are inserted in the corresponding round holes. Two opposite circular holes and a square aperture are formed on the first end of the middle pipe. Two opposite foursquare holes are formed on the second end of the middle pipe. The middle sleeve has a brim flange and two opposite circular protrusions disposed on an outer periphery of the middle sleeve. The circular protrusions are inserted in the corresponding circular holes. The foursquare holes match the corresponding square hole. A through hole is formed on a first end of the inner pipe. The first end of the inner pipe is fastened in a grip via the through hole. Two foursquare apertures are formed on a second end of the inner pipe. The foursquare apertures match the corresponding square aperture. The middle seat has a first window formed on a front face of the middle seat, and a first slot and a first hollow box formed on two opposite sides of the middle seat. The first hollow box receives a first spring and a first slide block. The first spring is disposed between the first hollow box and the first slide block. The first slide block has a first tang, a first bevel on the first tang, and a first periphery flange beneath the first tang. The first tang passes through the foursquare holes and the square hole and protrudes out of the outer pipe. The inner seat has a second window formed on a front face of the inner seat, and a second slot and a second hollow box formed on two opposite sides of the inner seat. The second hollow box receives a second spring and a second slide block. The second spring is disposed between the second hollow box and the second slide block. The second slide block has a second tang, a second bevel on the second tang, and a second periphery flange beneath the second tang. The second tang passes through the foursquare apertures and the square apertures and protrudes out of the middle pipe. The grip is pushed downward to force the second tang entering the inner pipe and the first tang entering the middle pipe. Thus the inner pipe is retracted in the middle pipe and the middle pipe is retracted in the outer pipe.

DETAILED DESCRIPTION OF THE INVENTION

Figure 1:
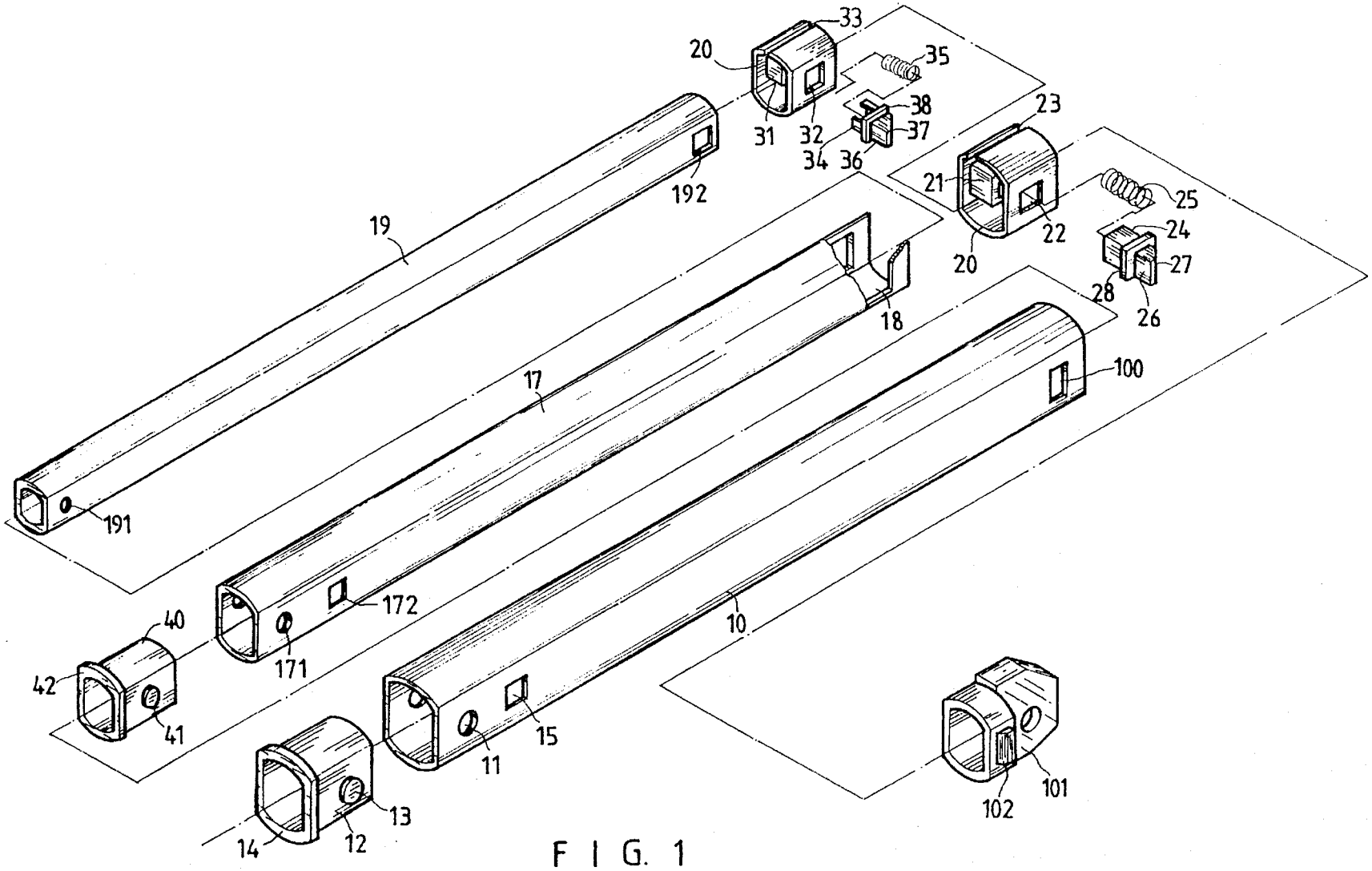
FIG. 1 is a perspective exploded view of a retractable handle device of a preferred embodiment in accordance with the present invention.
Figure 2:
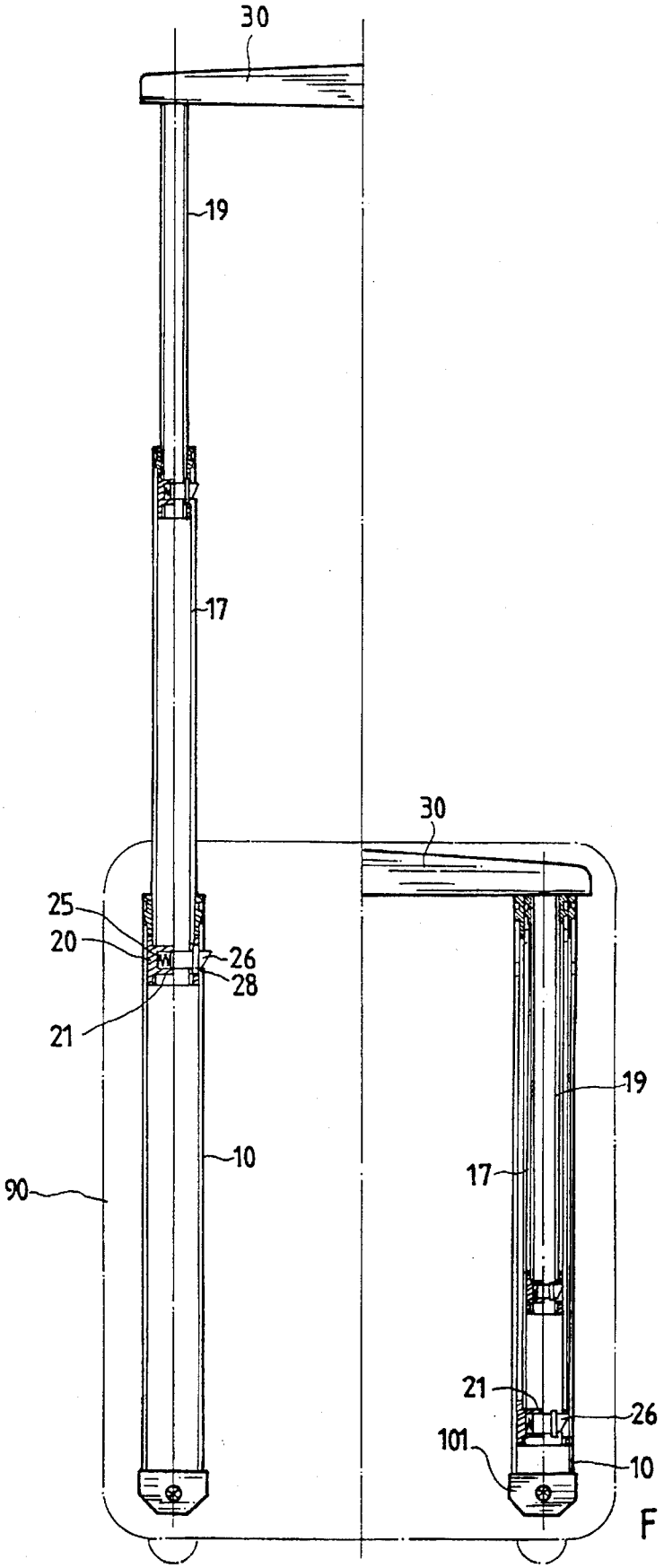
FIG. 2 is a schematic view illustrating a retractable handle device which is retracted and another retractable handle device which is extended.
Figure 3:
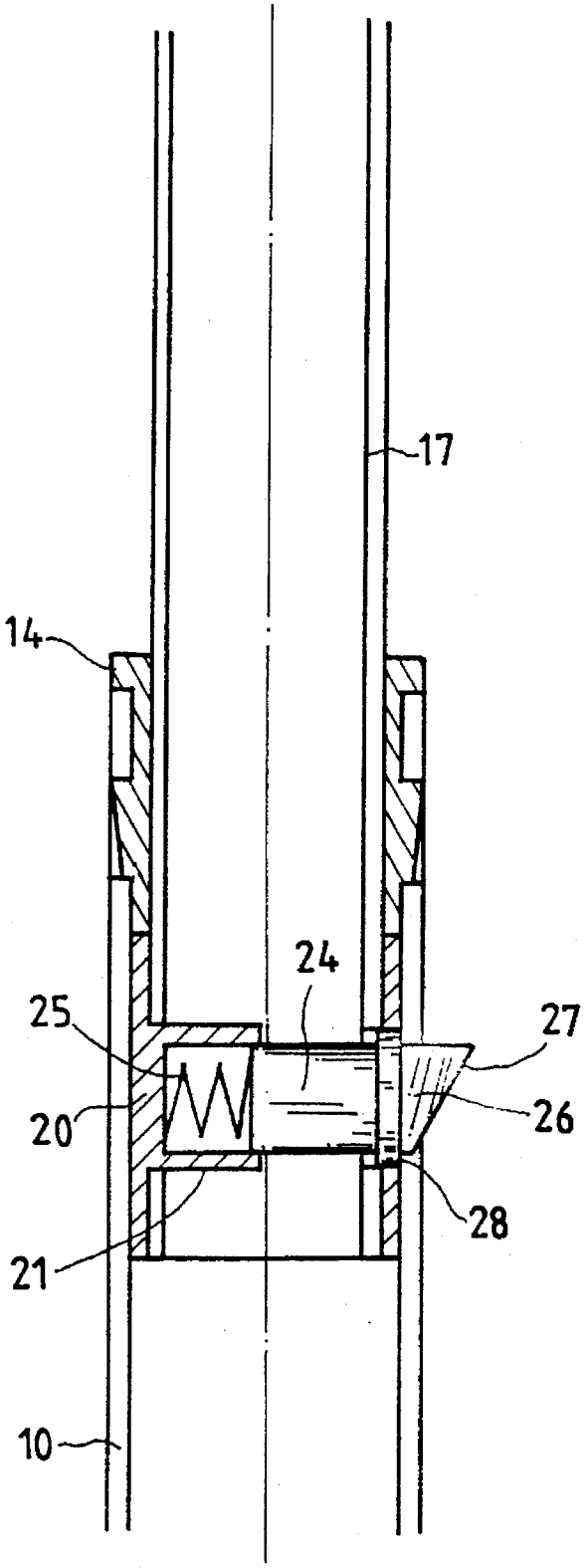
FIG. 3 is a sectional view illustrating an outer pipe connecting a middle pipe.

Referring to FIGS. 1 to 3, a retractable handle device comprises an outer seat 101, a middle seat 20, an inner seat 30, an outer sleeve 12, a middle sleeve 40, an outer pipe 10, a middle pipe 17 and an inner pipe 19. The outer seat 101 is fastened at an inner bottom of a suitcase 90. The outer sleeve 12 is inserted in a first end of the outer pipe 10. The outer seat 101 is inserted in a second end of the outer pipe 10. The middle sleeve 40 is inserted in a first end of the middle pipe 17. A second end of the middle pipe 17 is inserted in the middle seat 20. A second end of the inner pipe 19 is inserted in the inner seat 30. The inner pipe 19 is disposed in the middle pipe 17. The middle pipe 17 is disposed in the outer pipe 10. The outer seat 101 has an oblong protrusion 102. Two opposite round holes 11 and a square hole 15 are formed on the first end of the outer pipe 10. An oblong hole 100 is formed on the second end of the outer pipe 10. The oblong protrusion 102 is inserted in the oblong hole 100. The outer sleeve 12 has a rim flange 14 and two opposite round protrusions 13 disposed on an outer periphery of the outer sleeve 12. The round protrusions 13 are inserted in the corresponding round holes 11. Two opposite circular holes 171 and a square aperture 172 are formed on the first end of the middle pipe 17. Two opposite foursquare holes 18 are formed on the second end of the middle pipe 17. The middle sleeve 40 has a brim flange 42 and two opposite circular protrusions 41 disposed on an outer periphery of the middle sleeve 40. The circular protrusions 41 are inserted in the corresponding circular holes 171. The foursquare holes 18 match the corresponding square hole 15. A through hole 191 is formed on a first end of the inner pipe 19. The first end of the inner pipe 19 is fastened in a grip 30 via the through hole 191. Two foursquare apertures 192 are formed on a second end of the inner pipe 19. The foursquare apertures 192 match the corresponding square aperture 172. The middle seat 20 has a first window 22 formed on a front face of the middle seat 20, and a first slot 23 and a first hollow box 21 formed on two opposite sides of the middle seat 20. The first hollow box 21 receives a first spring 25 and a first slide block 24. The first spring 25 is disposed between the first hollow box 21 and the first slide block 24. The first slide block 24 has a first tang 26, a first bevel 27 on the first tang 26, and a first periphery flange 28 beneath the first tang 26. The first tang 26 passes through the foursquare holes 18 and the square hole 15 and protrudes out of the outer pipe 10. The inner seat 30 has a second window 32 formed on a front face of the inner seat 30, and a second slot 33 and a second hollow box 31 formed on two opposite sides of the inner seat 30. The second hollow box 31 receives a second spring 35 and a second slide block 34. The second spring 35 is disposed between the second hollow box 31 and the second slide block 34. The second slide block 34 has a second tang 36, a second bevel 37 on the second tang 36, and a second periphery flange 38 beneath the second tang 36. The second tang 36 passes through the foursquare apertures 192 and the square apertures 172 and protrudes out of the middle pipe 17.

The grip 30 is pushed downward to force the second tang 36 entering the inner pipe 19 and the first tang 26 entering the middle pipe 17. Thus the inner pipe 19 is retracted in the middle pipe 17 and the middle pipe 17 is retracted in the outer pipe 10.

The invention is not limited to the above embodiment but various modification thereof may be made. Further, various changes in form and detail may be made without departing from the scope of the invention.

I claim:

1. A retractable handle device comprising an outer seat, a middle seat, an inner seat, an outer sleeve, a middle sleeve, an outer pipe, a middle pipe and an inner pipe, the outer sleeve inserted in a first end of the outer pipe, the outer seat inserted in a second end of the outer pipe, the middle sleeve inserted in a first end of the middle pipe, a second end of the middle pipe inserted in the middle seat, a second end of the inner pipe inserted in the inner seat, the inner pipe disposed in the middle pipe, the middle pipe disposed in the outer pipe, and an improvement wherein:

the outer seat has an oblong protrusion, two opposite round holes and a square hole are formed on the first end of the outer pipe, an oblong hole is formed on the second end of the outer pipe, the oblong protrusion is inserted in the oblong hole, the outer sleeve has a rim flange and two opposite round protrusions disposed on an outer periphery of the outer sleeve, the round protrusions are inserted in the corresponding round holes, two opposite circular holes and a square aperture are formed on the first end of the middle pipe, two opposite foursquare holes are formed on the second end of the middle pipe, the middle sleeve has a brim flange and two opposite circular protrusions disposed on an outer periphery of the middle sleeve, the circular protrusions are inserted in the corresponding circular holes, the foursquare holes match the corresponding square hole, a through hole is formed on a first end of the inner pipe, the first end of the inner pipe is fastened in a grip via the through hole, two foursquare apertures are formed on a second end of the inner pipe, the foursquare apertures match the corresponding square aperture, the middle seat has a first window formed on a front face of the middle seat, and a first slot and a first hollow box formed on two opposite sides of the middle seat, the first hollow box receives a first spring and a first slide block, the first spring is disposed between the first hollow box and the first slide block, the first slide block has a first tang, a first bevel on the first tang, and a first periphery flange beneath the first tang, the first tang passes through the foursquare holes and the square hole and protrudes out of the outer pipe, the inner seat has a second window formed on a front face of the inner seat, and a second slot and a second hollow box formed on two opposite sides of the inner seat, the second hollow box receives a second spring and a second slide block, the second spring is disposed between the second hollow box and the second slide block, the second slide block has a second tang, a second bevel on the second tang, and a second periphery flange beneath the second tang, the second tang passes through the foursquare apertures and the square apertures and protrudes out of the middle pipe, and wherein the grip is pushed downward to force the second tang entering the inner pipe and the first tang entering the middle pipe, and the inner pipe is retracted in the middle pipe and the middle pipe is retracted in the outer pipe.

* * * * *